United States Patent [19]

Ratelle et al.

[11] 3,942,565

[45] Mar. 9, 1976

[54] LOG CLEANING AND BARKING

[75] Inventors: Clément Ratelle, Ville St. Laurent; Pierre Rouillard, Repentigny, both of Canada

[73] Assignee: Clément Ratelle, St. Laurent, Canada

[22] Filed: July 26, 1974

[21] Appl. No.: 492,160

[30] Foreign Application Priority Data

Aug. 2, 1973 Canada ..... 178012

[52] U.S. Cl. ..... 144/311; 15/104.04; 144/208 D

[51] Int. Cl.[2] ..... B27L 1/00

[58] Field of Search ..... 144/208 R, 208 E, 208 D, 144/311; 15/104.4, 104

[56] References Cited

UNITED STATES PATENTS

| | | | |
|---|---|---|---|
| 314,876 | 3/1885 | Poole et al. | 144/208 E |
| 2,473,461 | 6/1949 | White | 144/208 D |
| 2,611,401 | 9/1952 | Burton | 144/208 D |
| 2,643,691 | 6/1953 | Rockwood | 144/208 D |
| 2,709,465 | 5/1955 | Hansel | 144/208 D |
| 2,765,012 | 10/1956 | Riddell et al. | 144/208 D |
| 2,809,683 | 10/1957 | Hoiss | 144/208 D |

*Primary Examiner*—J. M. Meister
*Assistant Examiner*—W. D. Bray

[57] ABSTRACT

A method and a machine for cleaning and barking a log using fluid jets wherein the bark is first cut into longitudinal strips by a first series of fluid jet nozzles predominantly arranged to produce a cutting impingement action and wherein the anteriorly formed bark strips are peeled from the wood of the log by a second series of fluid jet nozzles predominantly arranged to produce a peeling action. The machine includes an automatic device to adjust the position of the fluid jet nozzles relative to a diametrical size of the log.

13 Claims, 11 Drawing Figures

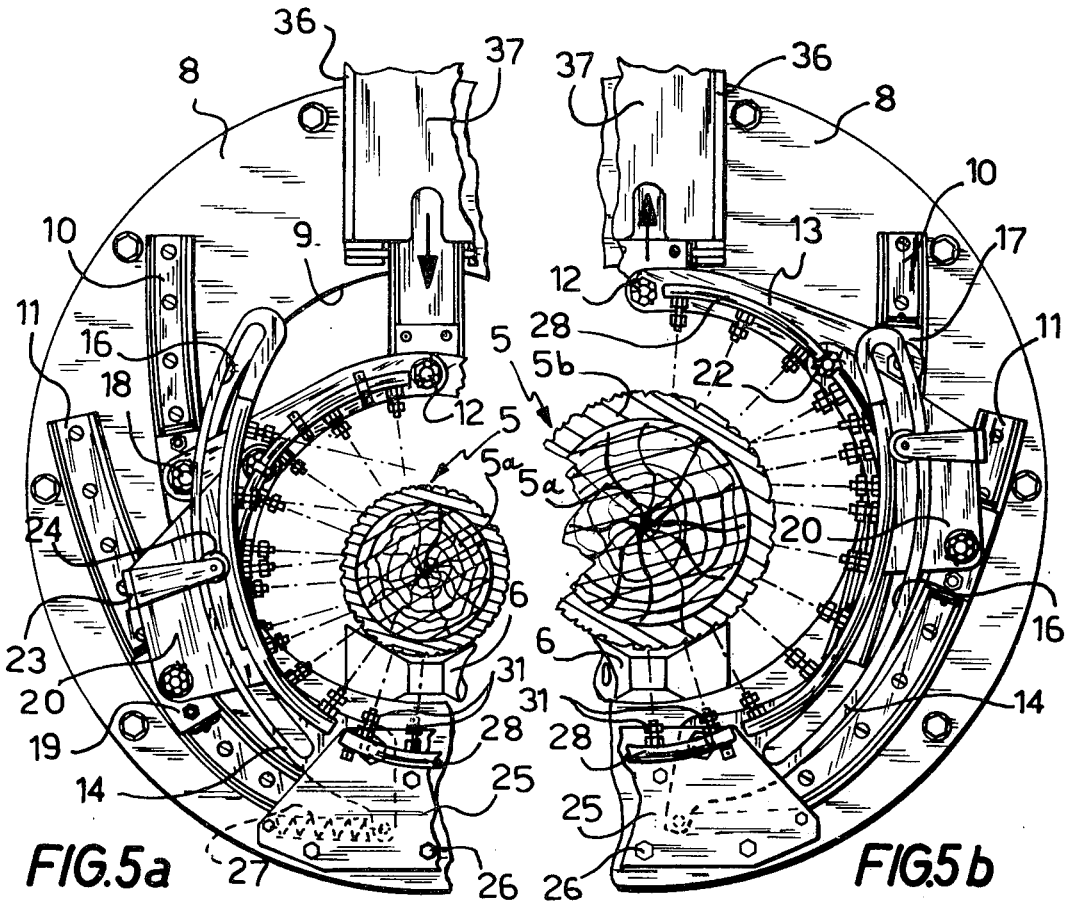
FIG.5a
FIG.5b
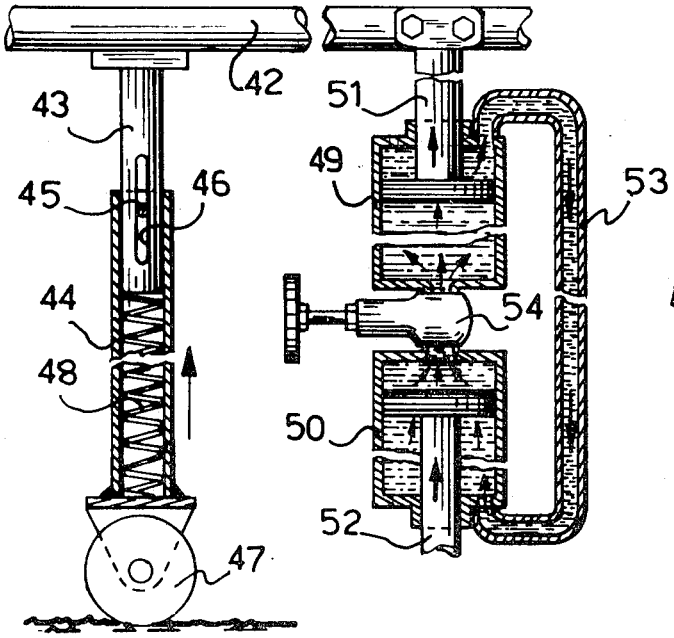
FIG.6

LOG CLEANING AND BARKING

This invention relates to log cleaning and barking and, more particularly, to a method and a machine of the type adapted for barking by fluid jets.

The barking machines of the above type which have been proposed so far are using fluid jets directed either merely radially inwardly in an orthogonal plane relative to the log or converging longitudinally of the same. It is found that along neither of these directions of the fluid jets is satisfactory.

It appears that the radial jets are primarily effective to cut through the bark but are relatively ineffective to remove the latter, since, to do so, they must cut through and impinge against substantially the whole area of the bark so as to cut the latter into small pieces.

When the fluid jets instead are, as proposed in the prior art, merely converging longitudinally in opposite direction relative to the uncoming log, a still less efficient result is obtained than when merely radial jets are used.

The applicant has noted that the bark is normally held around a log by essentially two bonds, one of which being the circumferential tensile strength of the bark and the other being the adherence between the bark and the wood of the log. Neither of the above-mentioned types of fluid jets appears to be satisfactorily effective to break both of these bonds. The applicant finds reasonable to assume that the radial jets are little effective on the adherence while the longitudinally converging jets are little effective on the circumferential tensile strength.

It is a general object of the invention to provide a barking method and a machine of the above type, which are relatively more effective and produce reduced consumption of high pressure fluid than heretofore achieved with the methods and machines of the prior art.

It is a more specific object of the invention to provide a barking method and a barking machine wherein two sets or series of fluid jets are used to sequentially break the circumferential bond by longitudinally cutting of the bark and thereafter the adherence bond by longitudinal peeling of the bark strips anteriorly produced by the longitudinal cutting.

It is a still further object of the invention to provide a method and a machine whereby barking is produced by first longitudinally cutting the bark into strips using a first series of fluid jet nozzles and thereafter peeling the bark strips using a second series of fluid jets nozzles wherein the nozzles are arranged to produce optimized cutting and peeling impingement actions respectively.

The above and other objects and advantages of the invention will be better understood in the light of the following detailed description of a preferred embodiment thereof which is illustrated, by way of example, in the accompanying drawings, in which.

Figure 2:
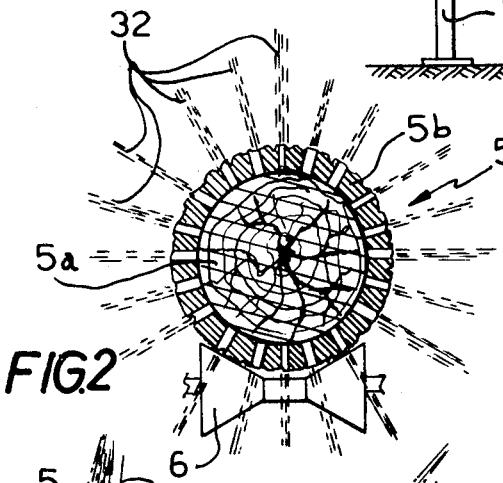
FIG. 2 is a cross-sectional view of a log as seen along line 2—2 in FIG. 1 with a first series of fluid jets impinging thereon for strip cutting action.
Figure 2A:
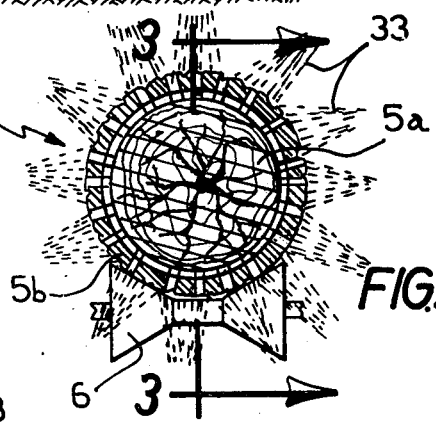
Figure 3:
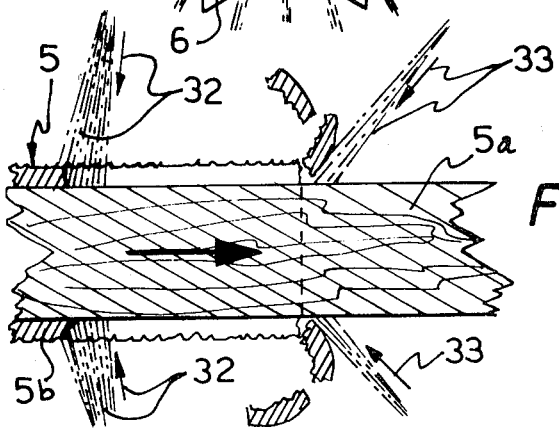

FIG. 2*a* is a cross-sectional view as in FIG. 2 but showing the second series of fluid jets impinging thereon for strip peeling action;

FIG. 3 is a cross-sectional view as seen along line 2—2 in FIG. 2*a;*

Figure 1:
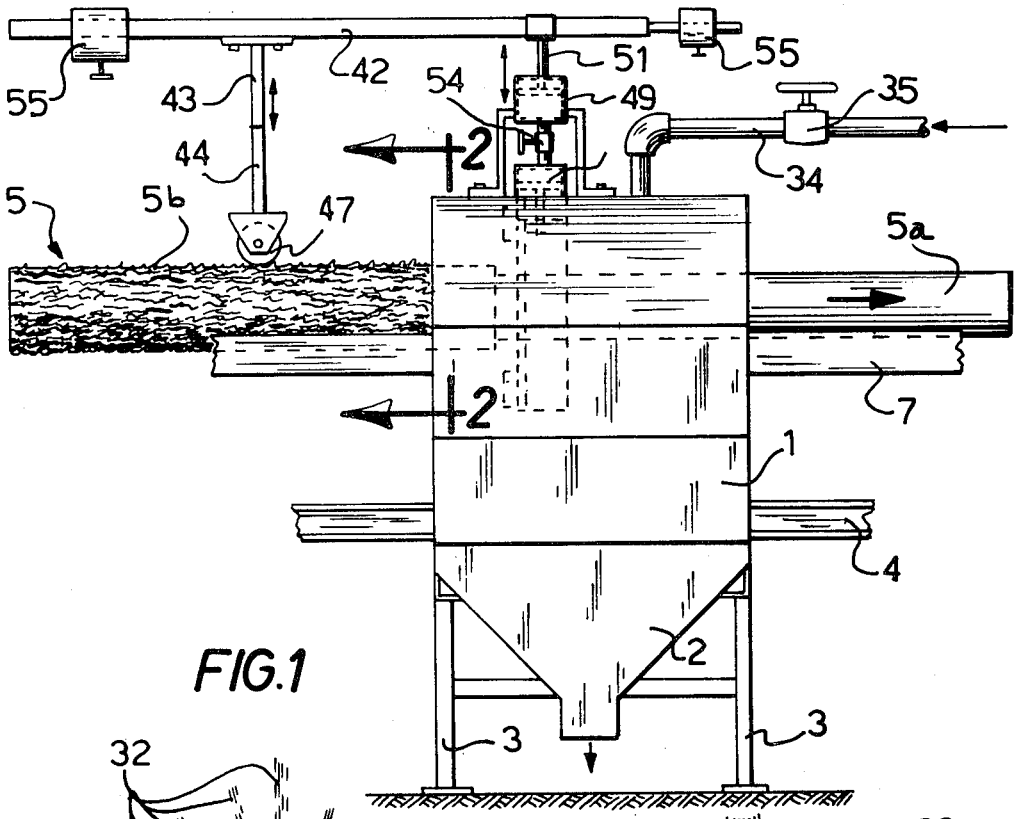
FIG. 1 is a side elevation view of a log cleaning and barking machine according to the invention.
Figure 4:
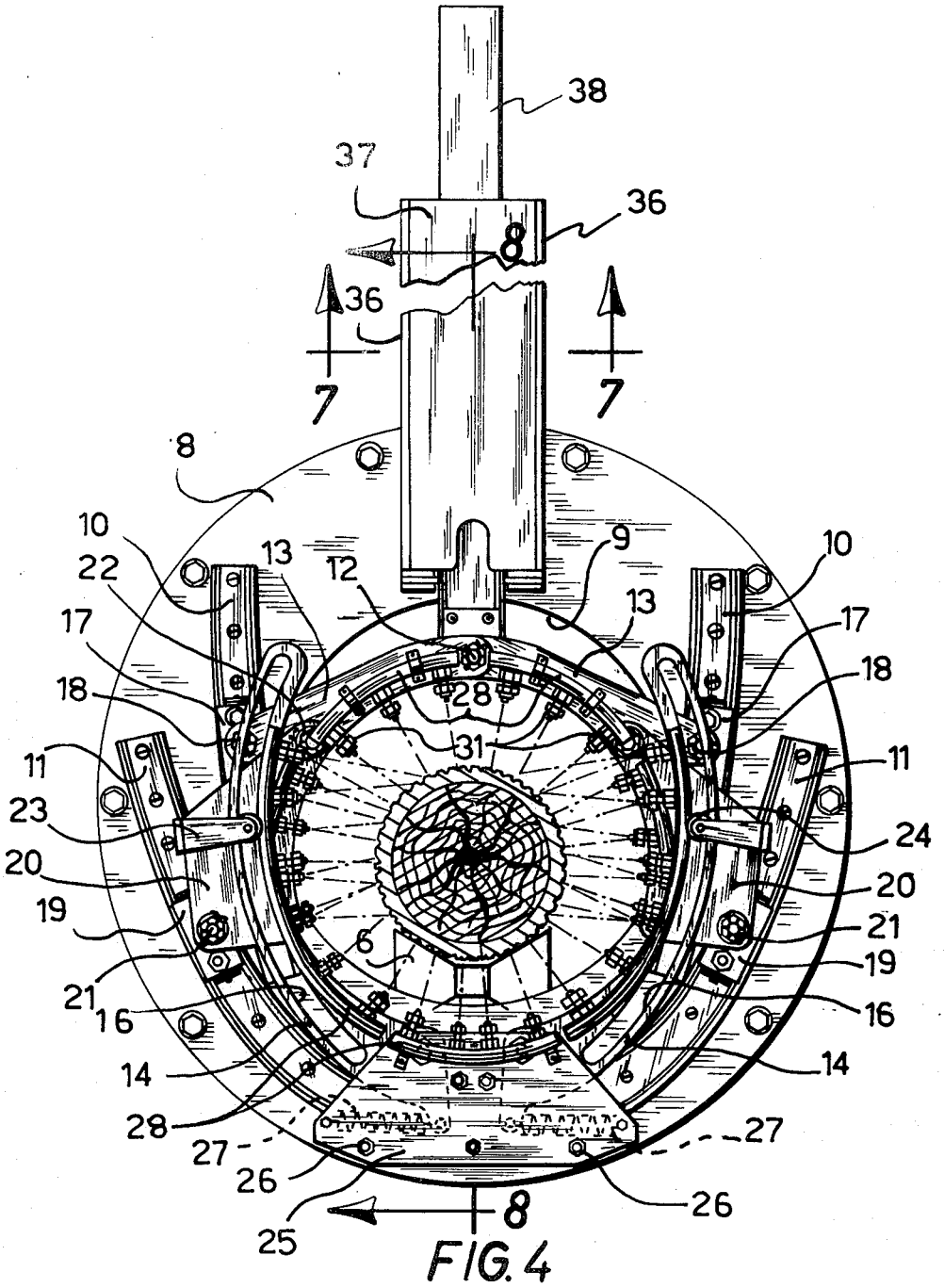
Figure 7:
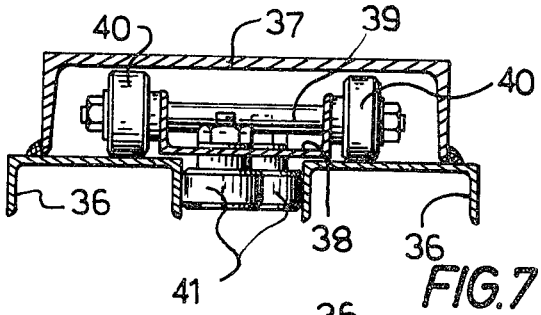
Figure 8:
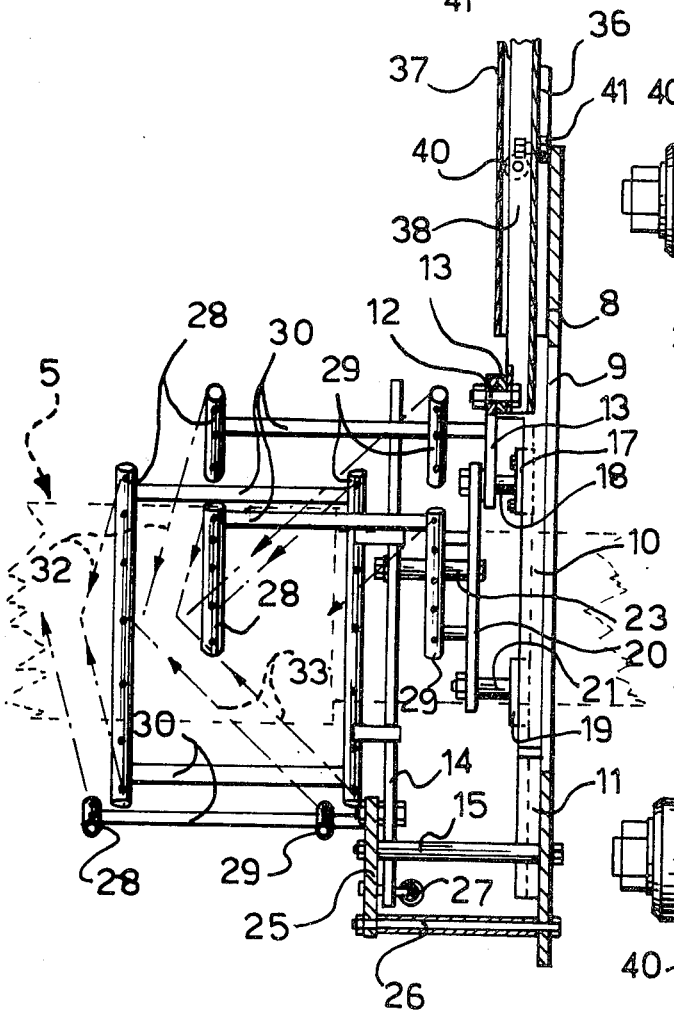
Figure 9:
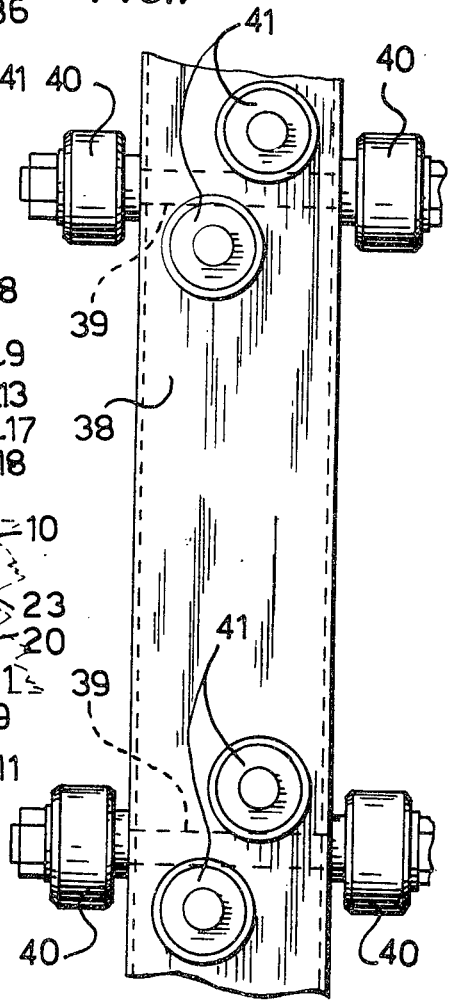

FIG. 4 is a partial view as seen from the left side in FIG. 1 within medium size log positioned into the machine;

FIGS. 5*a* and 5*b* are left and right partial views respectively of FIG. 4 with logs of smaller and larger diametrical sizes respectively into the machine;

FIG. 6 is an enlarged elevation view of the diametrical size feeler device of FIG. 1, with parts thereof shown in cross-section;

FIG. 7 is a cross-sectional view of a carriage assembly as seen along line 7—7 in FIG. 4;

FIG. 8 is a cross-sectional and schematic view as seen along line 8—8 in FIG. 4; and FIG. 9 is an elevation view of a carriage forming part of the illustrated embodiment.

The method according to the present invention consists in first subjecting the bark around a log to a first series of radially converging fluid jets by impinging the latter in circumferentially spaced-apart relationship onto the bark while advancing the log endwise centrally of these jets to cut the bark into strips lengthwise of the log. The anteriorly formed bark strips are thereafter subjected to a second series of fluid jets converging longitudinally in opposite direction relative to the direction of endwise displacement of the log to the strips from the wood of the log.

In other words, this method presumably first breaks the circumferential bonds produced by the circumferential tensile strength through the action of the first series of jets and to thereafter defeat the adherence of the bark onto the wood of the log using the peeling action of the second series of jets.

The method further includes forming the jets of the first series circumferentially narrow and forming the jets of the second series tangentially broader or fan-like for good cutting and peeling respectively.

The illustrated machine includes a casing 1 adapted to collect the chips and strips of bark, and having a funnel-shape chute 2 at the bottom for the exit and removal of the bark. The casing 1 may be supported in any suitable manner as per metal legs 3 and horizontal braces 4. A log conveyor extends through the casing 1, from left to right, as seen in FIg. 1, for similar endwise displacement of a log 5 along a predetermined log path. This log conveyor essentially includes, as is well known, a series of rollers 6 rotatably supported parallel to each other by beams 7 engaging the opposite ends thereof. The log 5 includes a core 5*a* of wood surrounded by bark 5*b*.

A flat mounting ring 8 having an aperture 9 is rigidly mounted into the casing 1 in circumscribing relationship with the log path and preferably in an orthogonal plane relative to the latter for the endwise displacement of the log 5 therethrough. On each side of half of the ring 8 relative to a vertical and axial plane therethrough, there are secured a first and a second guide channels or guide tracks 10 and 11 respectively. The latter are rigidly secured flat against one face of the ring 8 and converge downwardly centrally towards an intermediate bottom position of the latter.

A pivot pin 12 extends longitudinally of the log path in overlying relationship of the log 5 therein. A pair of first segments 13 are pivotally mounted at one end onto the common pivot pin 12 thereof and project in opposite directions laterally therefrom in circumferential relationship with respect to the log path and a log 5 therein. A second segment 14 is pivoted on each of the afore-mentioned side of the flat ring 8 about a pivot pin 15 secured endwise to the latter at the aforementioned intermediate position. As shown in FIGS. 4, 5*a*, and 5*b*, each second segment 14 is curved concavely towards the log path and extends in circumferential relationship relative to the latter. A groove 16 extends lengthwise into each second segment 14 and is similarly curved as the latter to form a predetermined slide.

A first sliding block 17 is engaged into each guide channel 10 for sliding displacement along the latter. The outer end of each first segment 13 is pivoted by a pin 18 relative to the corresponding first sliding block 17. A second sliding block 19 similarly engages each guide channel 11 for sliding displacement along the latter. A third segment 20 is provided on each side of the log path and is pivoted in the corresponding second sliding block 19 by a pivot pin 21 and on the corresponding first segment 13 by a pivot pin 22. Each third segment 20 has a bracket 23 secured rigidly thereto, projecting longitudinally therefrom away from the flat ring 8 and carrying a roller 24 rotatably engaged into the curved slot 16 of the corresponding third segment 14 to pivot the latter about the pivot pin 15. It must be noted that the segments 13, 14, and 20 are so interconnected and arranged relative to each other and to guide channels 10 and 11 that up-and-down displacement of the pivot pin 12 results in concurrent pivotal displacement of these segments radially away and towards the log 5 respectively. Consequently, these segments will tend to remain circumferentially coaxial with the log upon appropriate displacement of the pivot pin 12.

A fixed segment 25 is secured by bolts 26 and spacer tubes to the flat ring 8 at the above-mentioned predetermined bottom position intermediate the pairs of guide channels 10, 11. A spring 27 is connected intermediate each second segment 14 and the fixed segment 25 and is arranged to bias the corresponding segment 14 towards radially inward pivoting relative to the log path.

Each segment 13, 14, 20 and 25 supports a pair of manifilds 28 and 29 in spaced-apart relationship along the log patch by means of rigid links or bars 30, of any suitable configuration. The manifolds 28 and 29 are curved such as to extend substantially circumferentially relative to a log 5. It must be noted that the first set or series of manifolds 28 are arranged a calculated distance ahead of the second set or series along the log path. A first series of fluid jet nozzles 31 are connected to the manifolds 28 and project radially inward therefrom into a circular series. The nozzles 31 are constructed and arranged such that the fluid jets 32 issuing therefrom impinge substantially radially onto the bark 5*b* at circumferentially spaced-apart locations, as shown in FIGS. 2, 3, and 8. Furthermore, the fluid jet nozzles 31 of the first series are shaped to have a narrow circumferential impinging contact with the bark, as shown in FIG. 2, to enhance the predominantly cutting action thereof. Thus, longitudinal slits may be produced through the bark 5*b* by the nozzles 31 to cut the bark into longitudinal strips. A second series of fluid jet nozzles are similarly attached to the manifolds 29, but this time, to project inwardly such as to converge conically or longitudinally in the opposite direction relative to the direction of endwise displacement of the log 5, as indicated by the fluid jets 33 in FIGS. 2*a*, 3, and 8. Furthermore, the fluid jet nozzles of the manifolds 29 are constructed and arranged to produce fluid jets 33 which produce longitudinal narrow impinging contact and circumferentially relatively broader impinging contact to enhance the predominantly peeling action on the anteriorly formed bark strips. The high pressure fluid or water supply to each individual manifold may be made in any conventional manner through a supply pipe 34 having a hand valve 35 along the same.

Referring now more particularly to FIGS. 7, 8, and 9, a pair of channels 36 are secured in laterally spaced parallel and upright relationship against the upper portion of the flat ring 8. A wider channel 37 is welded against the back of the channels 36 and arranged to form an upright passage therewith. A carriage is rollably mounted into this passage for up-and-down displacement along the same. This carriage includes a channel section 38 extending lengthwise into the above upright passage. A pair of axles 39 project transversely through the side flanges of the channel section 38 and outwardly therefrom. Rollers 40 are secured to the axles 39 for rotary engagement with adjoining surfaces of the channels 36 and 37. Laterally guiding rollers 41 are rotatably secured to the channel section 38 and arranged to rollably engage the spaced-apart inner flanges of the channels 36, as shown in FIg. 7. As now shown in FIG. 8, the pivot pin 12 is secured to the channel section 38 to be vertically displaceable with the carriage of which the latter forms part.

As may be easily understood, the up-and-down displacement of the afore-mentioned carriage represented by the channel section 38 similarly displaces the pivot pin 12 and produces corresponding inward or outward displacement of the nozzles for radial adjustment of the latter in relation to the diametrical size of the log 5 which is being barked. Reference should now be made to FIGS. 1 and 6 for the detailed description of a feeler device adapted to sense the diametrical size of a log and to automatically adjust the radial position of the afore-mentioned nozzles through the displacement of the carriage.

The feeler device includes a rod or substantially horizontal bar 42 extending lengthwise in overlying relationship relative to the log path. A piston rod 43 is rigidly secured to the rod 42 and projects downwardly therefrom in diametrical alignment with a point of a log 5 which is approaching the fluid jet nozzles. A tubular member 44 slidably engages over the lower end of the piston rod 43 and defines a cylinder therefor. A pin 45 is secured transversely through the tubular member 44 adjacent the open end thereof and projects into a slot 46 running lengthwise into the piston rod 43. A roller 47 is rotatably secured to the lower end of the tubular member 44 and is arranged to run lengthwise onto the log 5. A spring 48 is arranged into the tubular member 44 to bias the latter and the roller 47 into engagement with the log.

A pair of hydraulic cylinders 49 and 50 are vertically aligned one with the other and with the carriage defined by the channel section 38. A piston rod 51 is secured to the rod 42 and slidably engages into the upper hydraulic cylinder 49 to produce a pumping action on the hydraulic fluid into the latter. Another piston rod 52 is operatively engaged into the hydraulic cylinder 50 and projects downwardly therefrom where it is connected to the channel section 38 to vertically displace the latter. A bypass conduit or pipe 53 interconnects the outer ends of the hydraulic cylinders 49 and 50 for reversible flow of the hydraulic fluid from the outer end of one cylinder to the outer end of the other cylinder. The two hydraulic cylinders 49 and 50 are intercommunicating at their adjoining ends by a regulating hand valve 54 which is provided to adjust the response of the hydraulic pistons to the variations in the diametrical size of the log. For instance, if the valve 54 is closed more, the further restriction to the direct passage of the hydraulic fluid through the valve makes it harder for the piston rods 51 and 52 to move into the cylinders 49 and 50. There results that the piston rod 43 will rather move relative to the tubular member 44. Adjustable weights 55 are slidably mounted onto the rod 42 to vary the load relationship onto and between the roller 47 and the piston rod 52 and also thence vary the response of the feeler device.

What we claim is:

1. In a log cleaning and barking machine provided with a conveyor producing endwise displacement of a log in a selected direction along a path extending through the machine, the combination comprising a first series of fluid jet nozzles surrounding the log path, converging radially inward towards the latter, and positioned for impingement of bark cutting fluid jets in circumferentially spaced-apart relationship and relatively orthogonally onto the bark of said log, a second series of fluid jet nozzles surrounding the log path and spaced down the latter relative to the first series and conically converging inward towards the log path and in opposite direction relative to said selected direction, and high pressure fluid supply means connected to said fluid jet nozzles and arranged to produce high pressure jets in the latter, whereby to cut said bark into strips longitudinally of said log with said first series of fluid jets and to thereafter peel said bark strips from the wood of said log with said second series of fluid jets.

2. A log cleaning and barking machine as defined in claim 1, wherein said fluid jet nozzles of said first series are arranged to produce circumferentially narrow impinging contact with the bark of said log and said fluid jet nozzles of said second series are arranged to produce tangentially broader and longitudinally narrow peeling contacts with said bark.

3. A log cleaning and barking machine as defined in claim 2, further including adjustable mounting means carrying said fluid jet nozzles and arranged for radial displacement of the latter in relation to the diametrical size of said log and coupling means rigidly connecting the fluid jet nozzles of said first series to the circumferentially corresponding fluid jet nozzles of said second series for concurrent radial displacement of the circumferentially corresponding fluid jet nozzles of said first and second series.

4. A log cleaning and barking machine as defined in claim 3, further including a diametrical size sensing device constructed and arranged to respond to said diametrical size of said log and connected to said adjustable mounting means to automatically and radially adjust the latter and said fluid jet nozzles in relation to said diametrical size.

5. A log cleaning and barking machine as defined in claim 4, wherein said adjustable mounting means includes guide tracks secured on two opposite sides of said predetermined log path, and nozzle carrying segments extending circumferentially around the latter and slidably connected to said guide tracks.

6. A log cleaning and barking machine as defined in claim 5, wherein said guide tracks constiture a pair of guide channels on each of said two opposite sides of said log path and converging towards the guide channels of the other pair and a position circumferentially intermediate said two opposite sides, said adjustable mounting means includes carriage means radially displaceable relative to said log path and diametrically opposite the latter relative to said intermediate position, and said nozzle carrying segments include on each of said opposite sides, a first segment pivoted at one end to said carriage means and pivotally slidable at the other end along one guide channel on said one side, a second segment pivoted at one end at said intermediate position and forming a slide projecting towards said first segment, and a third segment pivotally slidable onto the other guide channel, onto said slide of said second segment, and onto said first segment for concurrent radial displacement of said nozzle carrying segments.

7. A log cleaning and barking machine as defined in claim 6, wherein each of said nozzle carrying segments includes a manifold extending lengthwise circumferentially of said log path and said fluid jet nozzles are connected to said manifold and project radially inwardly therefrom.

8. A log cleaning and barking machine as defined in claim 7, wherein said adjustable mounting means includes a flat ring circumscribing said log path and having a central aperture adapted for said endwise displacement of a log therethrough, said guide channels are rigidly secured against said flat ring, said second segments are pivoted at said one end thereof to said flat ring, and a fixed segment is secured to the latter at said intermediate position and other fluid jet nozzles are carried by said fixed segment and converge radially in series with said fluid jet nozzles of said first and second series.

9. A log cleaning and barking machine as defined in claim 8, wherein said diametrical size sensing device includes a log diameter feeler device operatively engaging the peripheral surface of said log, connected to said carriage means and arranged to displace the latter in relation to said diametrical size of said log.

10. A log cleaning and barking machine as defined in claim 8, wherein said log diameter feeler device includes a piston rod slidably mounted for diametrical endwise displacement relative to said log, a roller rotatably connected to said piston rod and arranged for rolling engagement longitudinally on the outside of said log, a hydraulic cylinder, a first piston rod slidably engaged through one end of the latter and connected to said piston rod of said feeler device for endwise displacement thereof in relation to endwise displacement of the latter, second piston rod slidably projecting through the other end of said hydraulic cylinder and connected to said carriage means for displacement therewith and a bypass conduit interconnecting the opposite end portions of said hydraulic cylinder and arranged for closed circuit flow of a fluid from one to the other of said end portions in response to displacement of said first and second piston rods.

11. A log cleaning and barking machine as defined in claim 10, further including a valve mounted onto said hydraulic cylinder intermediate said first and said second piston rods and arranged to adjustably regulate the response of the latter to the changes in the sensed diametrical size of the log.

12. A method of barking a log comprising displacing a log endwise in a selected direction along a log path, projecting a first series of fluid jets in radially inward convergence in circumferentially spaced-apart relationship and orthogonally onto the bark around a log to produce bark strips longitudinally of the log and thereafter projecting a second series of fluid jets in conically inward convergence and longitudinal facing relationship relative to said selected direction of displacement of the log for peeling off the oncoming bark strips previously cut by the first series of fluid jets.

13. A method of barking a log as defined in claim 12, further including forming said fluid jets of said first series for relatively circumferentially narrow and spaced-apart impingement onto said bark to longitudinally cut the bark into bark strips on the log and forming said fluid jets of said second series for relatively circumferentially broader and longitudinally narrow impingment on said log to peel off said bark strips.

* * * * *